United States Patent [19]

Franz et al.

[11] 4,401,005

[45] Aug. 30, 1983

[54] ELECTRONIC KEYBOARD-OPERATED MUSICAL INSTRUMENT

[75] Inventors: Reinhard Franz, Tulpenstrasse 15, D-5401 Emmelshausen, Fed. Rep. of Germany; Wilfried Dittmar, Halsenbach, Fed. Rep. of Germany

[73] Assignee: Reinhard Franz, Emmelshausen, Fed. Rep. of Germany

[21] Appl. No.: 345,385

[22] Filed: Feb. 3, 1982

[30] Foreign Application Priority Data

Feb. 7, 1981 [DE] Fed. Rep. of Germany ..... 3104312

[51] Int. Cl.[3] ..... G10H 1/20; G10H 5/10

[52] U.S. Cl. ..... 84/1.01; 84/1.24; 84/445; 84/DIG. 26

[58] Field of Search ..... 84/1.01, 1.24, 445, 84/DIG. 26

[56] References Cited

U.S. PATENT DOCUMENTS

| | | | |
|---|---|---|---|
| 3,697,661 | 10/1972 | Deutsch | 84/1.01 |
| 3,816,637 | 6/1974 | Whitefield | 84/1.24 |
| 3,877,337 | 4/1975 | Obayashi et al. | 84/1.01 |
| 3,910,149 | 10/1975 | Obayashi | 84/1.01 |
| 3,971,282 | 7/1976 | Obayashi et al. | 84/1.01 |
| 4,012,982 | 3/1977 | Southard | 84/1.01 |

FOREIGN PATENT DOCUMENTS 2362609 6/1974 Fed. Rep. of Germany .

OTHER PUBLICATIONS

A. W. Critchley, "Multiplex Keying System for Organs", *Wireless World,* Jan. 1981, pp. 53–56.

*Primary Examiner*—Stanley J. Witkowski

*Attorney, Agent, or Firm*—Kontler, Grimes & Battersby

[57] ABSTRACT

An electronic organ has a digital control circuit with a sampling circuit (3) which generates key identification signals (B) in the form of pulse series wherein the pulses denote the actuated keys (2) of the keyboard (1). Such pulses cause a tone selector or evaluating circuit (12) to transmit tone signals to a voicer circuit (15). A shift register (16, 116 or 216) is provided to delay the key identification signals so that the tone signals which the voicer circuit receives do not correspond to those normally expected on actuation of certain keys. The non-delayed key signal can be superimposed upon the delayed signal or signals (V1, V2) in a suitable summing circuit (17) to thus achieve transpositions, interval couplings and other tonal effects.

15 Claims, 5 Drawing Figures

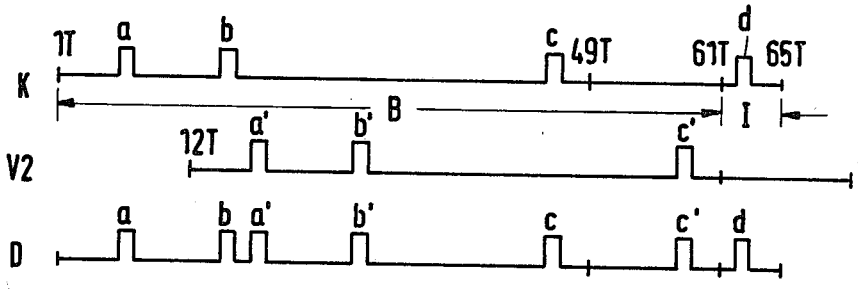
Fig.3
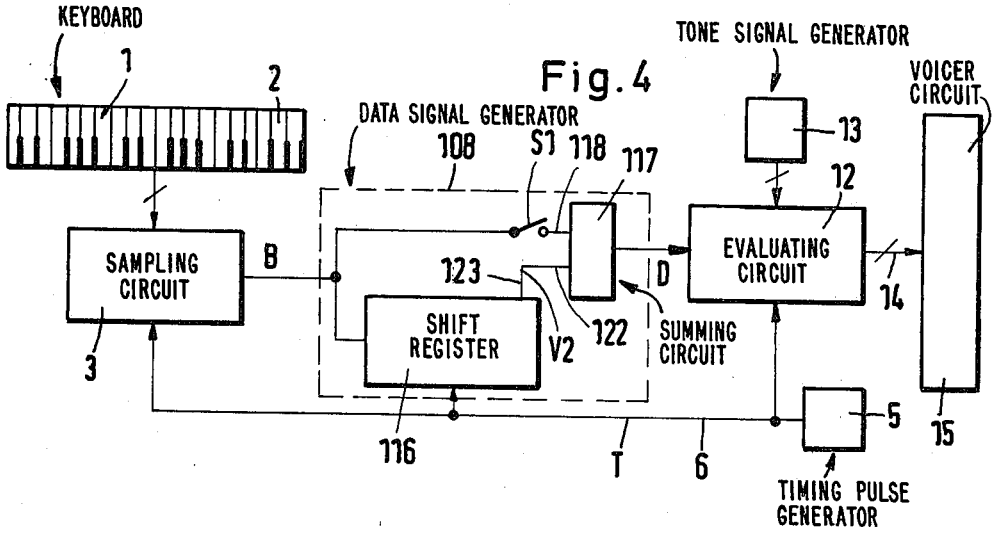
Fig.4
Fig.5
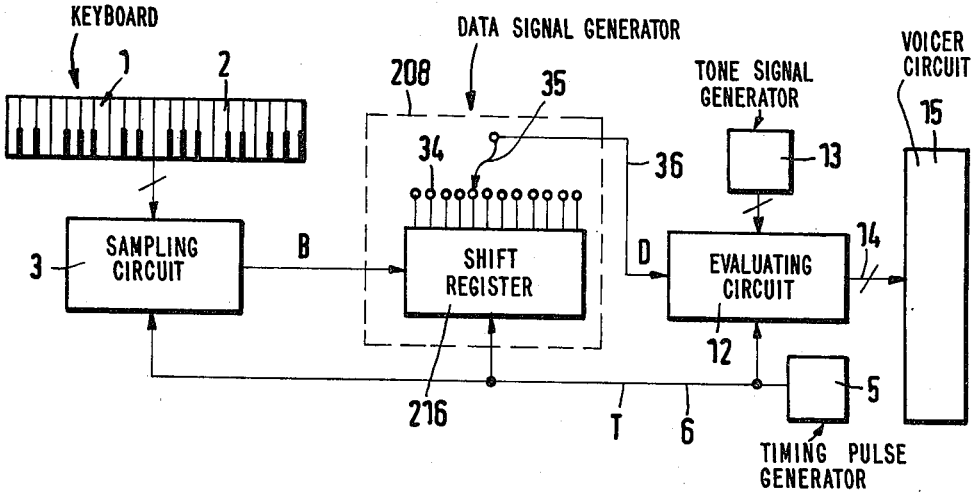

ELECTRONIC KEYBOARD-OPERATED MUSICAL INSTRUMENT

BACKGROUND OF THE INVENTION

The present invention relates to electronic keyboard-operated musical instruments in general, and more particularly to improvements in digital control circuit arrangements which can be used in electronic organs or analogous musical instruments and utilize a sampling circuit which generates a series of pulses denoting the actuated keys of a keyboard, a data signal generator with a time delay for transmission of data signals in dependency on the aforementioned series of pulses and a tone evaluating circuit which receives the data signals.

U.S. Pat. No. 3,697,661 granted Oct. 10, 1972 to Deutsch discloses a multiplexed pitch generator system for use in a keyboard-operated musical instrument wherein a shift register is utilized to delay the entire key signal, namely, the signal which denotes the actuated or depressed keys of the keyboard. In other words, the melody played by the operator of the keyboard has a footage or rank different from that which is associated with the notes corresponding to the actuated keys. The patented system further employs a summing circuit which is connectable with the input of the shift register on closing of a first switch and which is also connectable with various stages of the shift register on closing of additional switches. This means that actuation of a single key can effect the generation of several pitches. An advantage of the patented system is that the means for transmitting signals to the tone evaluating circuit comprises a small number of conductors. In fact, it is possible to operate with a single conductor. Reference may be had to pages 53–56 of the article by A. W. Critchley entitled "Multiplex keying system for organs" published in the January 1981 issue of "Wireless World."

German Auslegeschrift No. 23 62 609 discloses a circuit for transporting the pitch in an electronic keyboard-operated musical instrument wherein the transposing means employs shift registers.

A system known as Siemens SMT employs a control circuit without the possibility of delaying the key signals. The data signal which is generated by this system has sixtyfive time slots of which sixtyone are designed for a maximum of sixtyone keys (five octaves with twelve notes each and the highest C). The slots sixtytwo to sixtyfive are designed for four information pulses which denote, for example, the footages to be processed as well as the various types of sustain. The pulse frequency is in the range of 40 to 60 kilohertz. The sampling cycle invariably begins at the highest key of the keyboard. In the tone evaluating circuit, the pulses of the key signal are used directly to switching-through impulses so as to generate a tone which corresponds to the actuated key by taking into consideration the selected footage. The same system can be employed if the keyboard consists of fortynine keys (four octaves of twelve notes each and an upper C). The time slots one to twelve or fifty to sixtyone remain free as a result of shortening of the tone signal.

OBJECTS AND SUMMARY OF THE INVENTION

An object of the invention is to provide an electronic keyboard-operated musical instrument wherein the data signal which is transmitted to the voicer circuit is a function of a plurality of parameters, namely, the key signal and at least one additional signal.

Another object of the invention is to provide a digital control circuit which can be utilized in an electronic keyboard-operated musical instrument, such as an electronic organ, wherein the key signals are processed in a novel and improved way.

A further object of the invention is to provide a control circuit of the above outlined character which enables the musical instrument to produce a wide variety of tonal effects, such as transpositions, interval couplings and others.

An additional object of the invention is to provide a control circuit wherein delayed and non-delayed key signals are processed in a novel and improved way.

Another object of the invention is to provide a musical instrument which embodies the above outlined control circuit.

The invention resides in the provision of an electronic keyboard-operated musical instrument, such as an organ, which comprises at least one keyboard having a plurality of keys which are actuatable to initiate the generation of pulses, a sampling circuit which serves to cyclically scan the keyboard and to generate a series of key identification signals each constituting a series of pulses wherein the positions of the pulses are indicative of the actuated keys, a tone signal evaluating or selector circuit, a source of information signals (such information signals can denote at least one desired characteristic of tone signals, e.g., they can denote the depressed foot pedal or pedals or different sustain positions), and a data signal generator circuit having first and second inputs which are respectively connected with the sampling circuit and with the source of information signals, and an output connected with and arranged to transmit data signals to the evaluating circuit. The data signal generator circuit comprises a logic circuit or other suitable means for appending each information signal to a key identification signal to thereby generate a succession of composite or combination signals, a multi-stage shift register or an analogous time delay device having input means for reception of combination signals from the appending means and output means for delayed partial transmission of combination signals to the output of the generator circuit, and a flip-flop and/or other suitable means for blocking the transmission to the time delay device so that portion of each combination signal which constitutes the respective information signal. The musical instrument preferably further comprises means (such as a summing circuit) for connecting the appending means with the output of the generator circuit in response to blocking of transmission of aforementioned portions of combination signals to the time delay device.

Still further, the musical instrument can comprise means for controlling the operation of the blocking means, and such controlling means can comprise a timing pulse generator and counter means connected with the timing pulse generator and arranged to interrupt the transmission of a combination signal to the input means of the time delay device when the number of pulses furnished by the timing pulse generator within a cycle indicates that the input means of the time delay device is about to receive that portion of a combination signal which constitutes the respective information signal.

As mentioned above, the data signal generator circuit can comprise a summing circuit. A first input of such summing circuit is connectable with the appending means, at least one second input of the summing circuit is connectable with the output means of the time delay device, and the output of the summing circuit constitutes or can constitute the output of the data signal generator circuit. The aforementioned connecting means can include the summing circuit or is such connecting means interposed between the first input of the summing circuit and the appending means. The blocking means then allows for transmission of an information signal from the appending means to the first input of the summing circuit when the time delay device completes the transmission of key identification signal of the respective combination signal. The summing circuit can have several second inputs and the output means of the time delay then comprises a discrete output for each second input of the summing circuit. The discrete outputs of the time delay device serve to transmit to the summing circuit key identification signals of successive combination signals with different intervals of delay.

If the time delay device comprises or constitutes a shift register, the first or foremost stage of such shift register is connected with the input means of the time delay device. The musical instrument then further comprises means for connecting the timing pulse generator with the shift register so as to effect the advancement of signals and their pulses to the output means of the shift register. The just mentioned connecting means may comprise an inverter.

If the keyboard of the musical instrument has n octaves, the evaluating circuit can be designed for n+1 octaves. In such musical instruments, the tone signals of the additional octave of the evaluating circuit follow the pulse which is generated in response to sampling of the last-actuated key of the keyboard, and the pulses in that portion of each signal which appears at the output of the data signal generator circuit are those signals which are delayed by the shift register or another suitable time delay device.

The summing circuit can be installed in the data signal generator circuit in such a way that its first input is connectable with the appending means or directly with the sampling circuit and that its second input is permanently connected with the output means of the time delay device. The connection between the first input of the summing circuit and the appending means or the sampling circuit can comprise switch means which is actuatable to permit or prevent the transmission of pulses (of the indentifying signals) from the appending means to the first input of the summing circuit. If the time delay device is a shift register, the first stage of such shift register is connected with the appending means and a further stage (e.g., the eighth or the twelfth stage) is permanently connected with the second input of the summing circuit, i.e., the connection between the shift register and the summing circuit need not comprise any electronic or other switch means.

The novel features which are considered as characteristic of the invention are set forth in particular in the appended claims. The improved musical instrument itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 3 is a diagram showing series of pulses of the type generated and processed in the arrangement of FIG. 1;

FIG. 4 is a block diagram of a modified circuit arrangement wherein the shift register of the data signal generator circuit can effect only one type of signal delay; and FIG. 5 is a block diagram of a third circuit arrangement wherein a summing circuit of the arrangement shown in FIG. 1 as well as of the arrangement shown in FIG. 4 is dispensed with.

DESCRIPTION OF THE PREFERRED EMBODIMENTS

Figure 1:
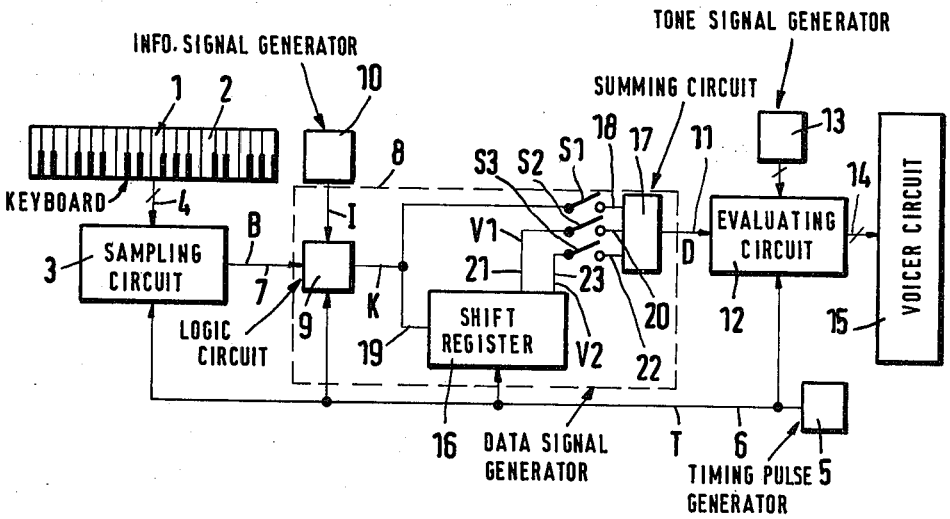
FIG. 1 is a block diagram of a first circuit arrangement wherein the shift register can delay the key identification signal more than once.

Referring first to FIG. 1, there is shown a keyboard 1 with fortynine keys 2, e.g., a manual of an electronic organ. A sampling or addressing circuit 3 is connected with the keyboard 1 by way of fortynine conductors 4 (one for each key 2) which transmit to the circuit 3 signals in response to actuation (depression) of the respective keys. The sampling circuit 3 comprises a parallel-series converter which receives timing pulses T from a timing or clock pulse generator 5 by way of conductor means 6. Consequently, a key identification signal B appears at the output 7 of the sampling circuit 3 upon completion of each sampling cycle, and the signal B is indicative of the actuated (depressed) keys 2. The key identification signal B is a train of pulses (note FIG. 3).

Each signal B and each timing pulse T is transmitted to a data signal generator circuit 8 which comprises a logic circuit 9, a time delay device in the form of a shift register 16 and a summing circuit 17. The logic circuit 9 is connected to the output of an information signal generator 10 which furnishes an information signal I (footage) for each key identification signal B (see the upper part of FIG. 3 and refer to the description of the SMT system of Siemens). Each information signal I constitutes a single pulse or a train of pulses. This results in the generation of combination or composite signals K (see FIG. 3) which appear at the output of the logic circuit 9 and are transmitted to the input 19 of the shift register 16. Thus, the logic circuit 9 appends an information signal I to each signal B so as to form a signal K.

In accordance with heretofore known proposals, the combination signal K would constitute a data signal D and would be transmitted directly to the input 11 of a tone selector or evaluating circuit 12. Another input of the tone selector circuit 12 is connected with a tone signal generator 13, and the circuit 12 contains tone shaping circuits. In dependency on the pulses of the key identification signal B (such pulses constitute switching pulses), and by taking into consideration the pulses of the information signal I, the signal generator 13 would transmit signals to its output terminal 14 and each such signal would be indicative of the actuated key 2 by further considering the selected footage (signal I). The low-frequency signals at the output terminal 14 of the circuit 12 would be processed in a voicer circuit 15 of the musical instrument; the circuit 15 contains tone processing stages, amplifier means and loudspeaker means.

In accordance with a feature of the present invention, the data signal generator circuit 8 further comprises the aforementioned shift register 16 and the summing circuit 17. The combination signal K is transmitted to the input 19 of the shift register 16 as well as to a first input 18 of the summing circuit 17. A second input 20 of the summing circuit 17 is connected with the output 21 of the eighth stage of the shift register 16, and a further input 22 of the summing circuit 17 is connected with the output 23 of the twelfth stage of the shift register 16. The three inputs 18, 21 and 22 of the summing circuit 17 are respectively controlled by switches S1, S2 and S3, preferably electronic switches of known design. It will be noted that, when the switch S2 is closed, the input 20 of the summing circuit 17 can receive (from the output 21 of the shift register 16) a signal V1 which is delayed by eight units of time and, when the switch S3 is closed, the input 22 of the summing circuit 17 can receive a signal V2 (from the output 23 of the shift register 16) which is delayed by twelve units of time. When the switches S1, S2 and S3 are closed, the signals V1 and V2 can be superimposed upon the signal K (the signal K is transmitted via switch S1, the signal V1 is transmitted via switch S2, and the signal V2 is transmitted via switch S3). The output 11 of the summing circuit 17 is the output of the data signal generator circuit 8, and such output transmits modified or non-modified signals K (namely, data signals D) to the corresponding input of the tone selector or evaluating circuit 12.

FIG. 3 shows that each composite or combination signal K is a series of pulses consisting of a key identification signal B and the corresponding information signal I. The three pulses a, b and c of the key identification signal B indicate that this signal was generated in response to actuation of three particular keys 2. Such pulses can occupy selected ones of the first fortynine increments of the signal B. The increments fifty through sixtyone remain unoccupied, and the increments sixtytwo to sixtyfive are taken up by the information signal I which, in FIG. 3, has a single pulse d.

It is now assumed that the switches S1 and S3 are closed, i.e., that the inputs 18 and 22 of the summing circuit 17 are ready to receive signals (K and V2). The signal V2 which is transmitted from the output 23 of the shift register 16 to the input 22 of the summing circuit 17 is delayed by twelve units of time with reference to the combination signal K which is transmitted from the output of the logic circuit 9 to the input 18 of the summing circuit 17. The pulses a, b and c of the signal K which was transmitted to the input 19 of the shift register 16 are respectively converted into pulses a', b' and c' of the signal V2 (note the middle part of FIG. 3), and the data signal D which appears at the output 11 of the summing circuit 17 exhibits the pulses a, b, a', b', c, c' and d as shown in the lower part of FIG. 3. The pulses a to c' of the signal D constitute switching-through pulses. The information signal pulse d does not have an equivalent in the signal V2 because the shift register 16 was blocked before the pulse d of the signal K, which was applied to the input 19 of the shift register 16, was able to reach the twelfth stage of this shift register. This can be readily seen in FIG. 3. It will be noted that the delayed signal V2 constitutes at least a portion of the corresponding data signal D.

If the sampling begins at the highest key 2, the delayed pulses cause the generation of lower tones. When the switches S1 and S3 are closed, one obtains an octave couple and, when the switches S1 and S2 are closed, one obtains a treble couple. If the sampling begins at the lowest key 2, the delay results in the generation of higher tones.

Figure 2:
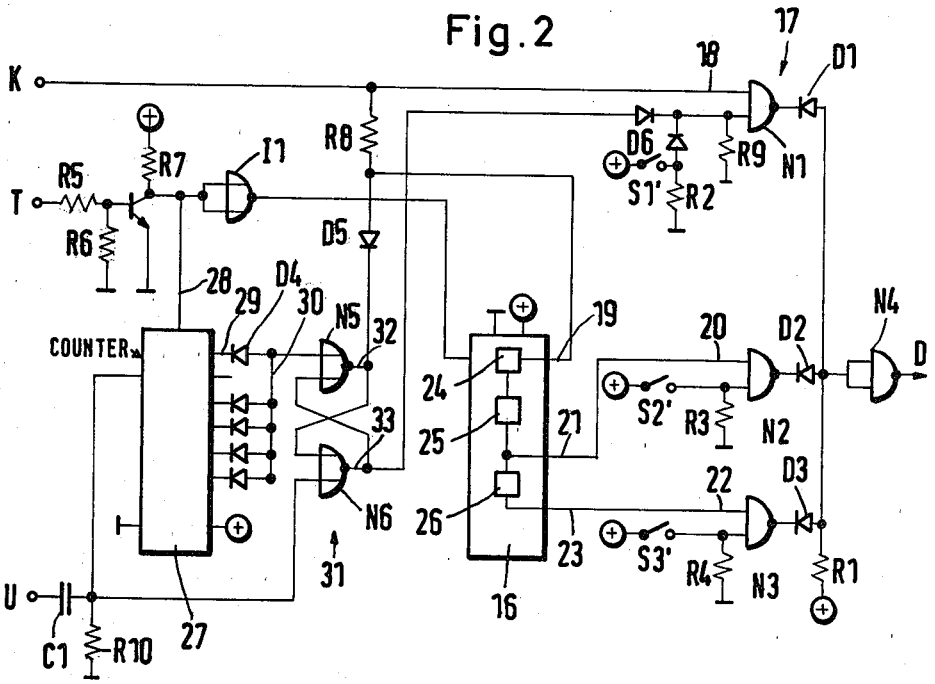
FIG. 2 is a block diagram of the data signal generator circuit in the arrangement of FIG. 1.

The details of the data signal generator circuit 8 are illustrated in FIG. 2. The summing circuit 17 of the circuit 8 comprises three NAND gates N1, N2 and N3 whose outputs are connected with the ground by way of the respective diodes D1, D2 and D3. The diodes D1 to D3 further connect the NAND gates N1 to N3 with the input of a fourth NAND gate N4 whose output transmits the data signal D, i.e., the output of the gate N4 constitutes or corresponds to the output 11 shown in FIG. 1. A resistor R1 is connected between the ground and the diodes D1 to D3. The upper inputs of the NAND gates N1, N2 and N3 respectively correspond to or constitute the inputs 18, 20 and 22 of FIG. 1, and the lower inputs of the NAND gates N1, N2 and N3 (as viewed in FIG. 2) are respectively connected with switches S1', S2' and S3' as well as with resistors R2, R3 and R4.

The timing or clock pulse generator 5 transmits timing pulses T by way of conductor means 6, and such signals are transmitted, by way of a series resistor R5 and a parallel-connected resistor R6, to the base of a transistor Tr1 whose collector is connected with the source of operating potential by way of a resistor R7 and whose emitter is connected to the ground. The potential at the collector of the transistor Tr1 is applied to the timing or signal advancing inputs of the shift register 16 by way of an inverter I1. The reference character 24 denotes an input stage of the shift register 16. The output 21 of the shift register 16 follows a group 25 of eight stages, and the output 23 follows a group 26 of four additional stages.

The transistor Tr1 further transmits amplified timing pulses T to the input 28 of a counter 27. The binary outputs 29 of the counter 27 are connected with one input of a NOR gate N5 by way of discrete diodes D4 and a conductor 30. The arrangement is such that the conductor 30 transmits a signal after elapse of an interval which is required to generate a succession of sixtyone timing pulses. The NOR gate N5 forms part of a flip-flop circuit 31 which further comprises a second NOR gate N6. When the conductor 30 transmits a signal to the corresponding input of the NOR gate N5, the output 32 of the flip-flop 31 transmits a ground signal and the output 33 transmits a positive voltage signal. At such instant, transmission of the first portion (B) of the combination signal K from the logic circuit 9 to the input 19 of the shift register 16 is interrupted because the signal which is transmitted via resistor R8 is shorted by a diode D5. At the same time, the switching input of the NAND gate N1 receives potential via diode D6 and resistor R9 so that the gate N1 transmits the remaining portion (I) of the signal K even if the switch S1' is open, i.e., even if the position or condition of the switch S1' would not warrant the transmission of signal K via NAND gate N1. This means that, starting with the pulse sixtytwo (i.e., prior to appearance of the information signal I), no further pulses are transmitted via shift register 16; instead, signals which would have been transmitted via shift register 16 are transmitted by way of the NAND gate N1, i.e., they bypass the shift register. The means for blocking the transmission of signals I to the input 19 includes the flip-flop 31 and the diodes D5, D6. The elements N5, D6 ensure that the signals I are transmitted directly to the input 19. Such elements are desirable and advantageous whenever it is possible (as a result of the provision of switches or the like) to transmit the signals B without delay.

Resetting of the counter 27 is effected by a resetting signal U which is rendered effective by way of a capacitor C1 and a resistor R10. The resetting signal U is further applied to and resets the flip-flop 31.

Data signals D which are influenced by the shift register 16 and transmitted to the circuit 12 cause the generation of tone signals which are shifted with reference to tone signals normally generated in response to depression of certain keys 2. If this principle is employed per se, one achieves a transposition. If this principle is resorted to simultaneously with transmission of undelayed key identification signals B, one achieves an interval coupling. An interval coupling with two or more tones is obtained if the summing circuit 17 comprises a first input (18) and more than one additional input (20, 22) for delayed signals. The switches S1 to S3 which are associated with the inputs 18, 20 and 22 can be actuated by the player of the musical instrument. In this manner, the player can select the desired effect (transposition or interval coupling with one or more tones).

As mentioned above, the logic circuit 9 of the data signal generator circuit 8 attaches or appends information signals I to the corresponding key identification signals B to form combination or composite signals K. Since the logic circuit 9 precedes the shift register 16 and in the absence of any measures to the contrary, the shift register would delay the information signals I with the result that the ciircuit 12 would treat such information signals improperly, i.e., the circuit 12 would interpret the presence of a pulse d as an indication that the corresponding pulse of the signal B is to be transmitted to the voicer circuit 15. This would result in the generation of undesired tones. As described above, the input 19 of the shift register 16 is blocked before such input can receive the portion I of the composite signal K and, in addition, the generator circuit 8 provides a bypass path for undelayed transmission of signals to the summing circuit 17 so that the pulses of each signal B invariably initiates the generation of desired tones.

An advantage of the counter 27 is that it allows for accurate identification or pinpointing of that portion of each data signal D which does not contain any pulse or pulses of the information signal I. This enables the generator circuit 8 and the circuits which follow to properly process the information signals. The counter 27 and the flip-flop 31 are reset upon completion of each cycle.

The summing circuit 17 is or can be of conventional design. It exhibits the advantage that several signals can be coupled to one another and that the information signal I can be transmitted to the tone evaluating circuit 12 without any influencing by the shift register 16. In other words, the information signals I can be transmitted from the logic circuit 9 to the circuit 12 by the simple expedient of closing the switch S1, i.e., such signals completely bypass the shift register 16.

The feature that the shift register 16 has an additional input stage 24 and that the generator 5 is connected with the shift register 16 by an inverter (I1) ensures that, owing to positions of the flanks of the timing pulses T, the shift register 16 can advance the signals furnished at 19 by a step at the time of reception of such information.

If the number of octaves in the keyboard 1 is n, the circuit 12 is or can be designed for n+1 octaves. The tone signals of the additional octave of the circuit 12 follow that tone signal which corresponds to the pulse generated on actuation of the last-addressed key (note the pulse c' of the data signal D in FIG. 3). In other words, in the data signal portion D between the increments fortynine and sixtyone of FIG. 3, the switching pulse c' is a pulse which was delayed by the shift register 16 and can be found in the last section of the key identification signal B. Thus, the just described feature renders it possible to fill the otherwise unused portions of each data signal or a selected data signal D with portions of the delayed signal (such as V2 of FIG. 3). If the circuit 12 is designed for evaluation of signals corresponding to n octaves (i.e., the same number as the number of octaves in the keyboard 1), it is necessary to provide suitable means for suppressing those portions of delayed signals which are outside of the evaluation range of the circuit 12. In other words, it is then necessary to suppress those portions of signals which are outside of the evaluating range of the circuit 12 owing to the fact that the signals were delayed by the shift register 16.

The arrangement which is shown in FIGS. 1 to 3 could be modified by replacing the illustrated time delay device 16 with two discrete shift registers each of which would receive the signals K, one of which would transmit delayed signals V1, and the other of which would transmit delayed signals V2. The illustrated arrangement is preferred because it is simpler in view of the utilization of a single shift register with several outputs (21, 23). The provision of an output (23) at the twelfth stage of the shift register 16 is normally desirable because this leads to an octave coupling which is often required when the instrument is in use. The provision of a discrete second output (21) which is connected with the eighth stage of the shift register 16 is desirable and advantageous because this leads to a tierce coupling whenever the sampling begins at the highest key of the keyboard 1. Such couplings are interesting when the musical instrument is to generate tones in imitation of chimes. The just mentioned tones cannot be generated with customary footages.

All such parts of the circuit arrangement shown in FIG. 4 which are identical with those of the arrangement shown in FIG. 1 are denoted by similar reference characters. The arrangement of FIG. 4 employs a modified data signal generator circuit 108 having a shift register 116 and a summing circuit 117. The output 123 of the twelfth stage of the shift register 116 is directly and permanently connected with the input 122 of the circuit 117, i.e., the switch S3 of FIG. 1 is omitted. The other input 118 of the circuit 117 is connectable with the output of the sampling circuit 3 by means of the switch S1, i.e., when the switch S1 is closed, the input 118 is connected directly with the input of the data signal generator circuit 108. It is assumed here that the key identification signal B is processed directly; however, it is clear that the arrangement of FIG. 4 can be designed to combine the signals B with information signals I.

The arrangement of FIG. 4 continuously provides a delayed signal V2 because the switch S3 of FIG. 1 is omitted Therefore, the tone selector circuit 12 always selects tones which are lower by one octave than the tones selected by the depressed keys 2 of the keyboard 1 which may constitute the manual of an electronic organ. For example, the arrangement of FIG. 4 is especially suited for use with the lower manual of a spinet organ because this renders it possible to design the sampling circuit for one of the manuals in such a way that it is identical with the sampling circuit for the other manual. When the switch S1 is closed, one achieves an octave coupling which ensures that the circuit 15 couples the basic tones with tones which are higher by one octave.

An advantage of the arrangement which is shown in FIG. 4 is that, when the sampling cycle begins at the uppermost key, the provision of the shift register 116 results in the generation of a deeper basic tone. A higher tone can be added by interrupting the blocking operation. Thus, the lower manual of a spinet organ can be shifted by one octave with reference to the upper manual in spite of the fact that the sampling circuits for both manuals are or may be of identical design.

FIG. 5 illustrates a portion of a third embodiment of the improved keyboard musical instrument. All such parts which are identical with or clearly analogous to the corresponding parts of the structure shown in FIG. 1 are denoted by similar reference characters. The data signal generator circuit 208 comprises a shift register 216 which has an output 34 for each of twelve neighboring stages. The outputs 34 can be connected with a common output line 36 by a preferably electronic selector circuit 35. The common output line 36 transmits the data signal D to the corresponding input of the tone evaluating or selector circuit 12. The just described arrangement constitutes a very simple transposing unit.

The arrangement of FIG. 5 exhibits the advantage that it allows for the generation of tone signals which lead to couplings with heretofore utterly unusual footages. All that is necessary is to cause the selector circuit 35 to connect the conductor (data signal line) with a desired output 34 of the shift register 216.

The elements of the various circuit arrangements are known per se. For example, the sampling circuit 3 can be assembled of two integrated circuits of the type SM 304 manufactured by Siemens, and the logic circuit 9 can be built directly into the circuit 3. Each of the shift registers 16, 116, 216 can be of the type CD 4006 manufactured by RCA. The tone selector circuit 12 (inclusive of the tone signal generator 13) can be of the type SM 305 manufactured by Siemens, and the counter 27 can be of the type CD 2024 manufactured by RCA.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an electronic keyboard-operated musical instrument, the combination of at least one keyboard having a plurality of keys which are actuatable to initiate the generation of pulses; a sampling circuit arranged to cyclically scan said keyboard and to generate a series of key identification signals each constituting a series of pulses wherein the positions of the pulses are indicative of the actuated keys; a tone signal evaluating circuit; a source of information signals; and a data signal generator circuit having first and second inputs respectively connected with said sampling circuit and said source, and an output connected with said evaluating circuit, said generator circuit comprising means for appending each information signal to a key identification signal so as to generate a succession of combination signals, a time delay device having input means for reception of said combination signals and at least one input means for delayed partial transmission of combination signals to the output of said generator circuit, and means for blocking the transmission to said device of that portion of each combination signal which constitutes the respective information signal.

2. The combination of claim 1, wherein said time delay device comprises a shift register.

3. The apparatus of claim 1, wherein said appending means comprises a logic circuit.

4. The apparatus of claim 1, wherein said source is arranged to transmit information signals denoting at least one desired characteristic of tone signals.

5. The combination of claim 1, wherein said blocking means comprises a flip-flop.

6. The combination of claim 1, further comprising means for connecting said appending means with the output of said generator circuit in response to blocking of transmission of said portions of combination signals to said device.

7. The combination of claim 6, further comprising means for controlling the operation of said blocking means, including a timing pulse generator and counter means connected with said timing pulse generator and arranged to interrupt the transmission of a combination signal to the input means of said device when the number of pulses furnished by said timing pulse generator within a cycle indicates that the input means of said device is about to receive that portion of a combination signal which constitutes the respective information signal.

8. The combination of claim 7, wherein said generator circuit further comprises a summing circuit having a first input connectable with said appending means, at least one second input connectable with the output means of said device, and an output constituting the output of said generator circuit, said connecting means being interposed between said appending means and the first input of said summing circuit and said blocking means being arranged to allow for transmission of an information signal from said appending means to the first input of said summing circuit when said device completes delayed transmission of the key identification signal of the respective combination signal.

9. The combination of claim 8, wherein said summing circuit has a plurality of second inputs and the output means of said device comprises a discrete output for each of said second inputs, said discrete outputs being arranged to transmit to said summing circuit the key identification signals of successive combination signals with different intervals of delay.

10. The combination of claim 1, further comprising a timing pulse generator, said device comprising a shift register having a foremost stage connected with said input means, and further comprising means for connecting said timing pulse generator with said shift register to effect the advancement of signals to said output means.

11. The combination of claim 10, wherein the means for connecting said timing pulse generator with said shift register comprises an inverter.

12. The combination of claim 1, wherein said keyboard has n octaves and said evaluating circuit is designed for n+1 octaves, the tone signals of the additional octave of said evaluating circuit following the pulse which is generated in response to sampling of the last-actuated key of the keyboard, the pulses in that portion of each signal which appears at the output of said generator circuit being those signals which are delayed by said device.

13. The combination of claim 1, wherein said generator circuit further comprises a summing circuit having a first input connectable with said appending means and a second input permanently connected with the output means of said device.

14. The combination of claim 13, further comprising means for connecting the first input of said summing circuit with said appending means, said connecting means including switch means which is actuatable to permit or prevent the transmission of pulses from said appending means to said first input.

15. The combination of claim 14, wherein said device comprises a shift register having a first stage connected with said appending means and a further stage permanently connected with the second input of said summing circuit.

* * * * *